US006035605A

United States Patent [19]

Perego

[11] Patent Number: 6,035,605

[45] Date of Patent: Mar. 14, 2000

[54] DEVICE FOR BENDING AND TRANSFERRING LEAFLETS INTO BOX-SHAPED CASINGS

[75] Inventor: Luciano Perego, Milan, Italy

[73] Assignee: Tapematic USA, Inc., Orlando, Fla.

[21] Appl. No.: 09/095,622

[22] Filed: Jun. 10, 1998

[30] Foreign Application Priority Data

Jul. 16, 1997 [EP] European Pat. Off. ..... 97830357

[51] Int. Cl.[7] ..... B65B 63/04

[52] U.S. Cl. ..... 53/117; 53/156; 53/157; 53/238; 53/254

[58] Field of Search ..... 493/92, 167, 171, 493/174, 465, 965; 53/50, 117, 156, 157, 238, 254, 429, 474

[56] References Cited

U.S. PATENT DOCUMENTS

| | | | |
|---|---|---|---|
| 4,283,190 | 8/1981 | Williams et al. . | |
| 4,685,277 | 8/1987 | Ilsemann | 53/474 |
| 4,852,327 | 8/1989 | Kurkowski et al. | 53/254 X |
| 5,163,271 | 11/1992 | Pan et al. | 53/474 X |
| 5,207,050 | 5/1993 | Fulkerson et al. | 53/474 |
| 5,285,620 | 2/1994 | Kaye et al. | 53/474 |
| 5,341,624 | 8/1994 | Kaye | 53/238 X |
| 5,664,405 | 9/1997 | Perego | 53/564 X |
| 5,788,114 | 8/1998 | Perego | 53/468 X |
| 5,816,028 | 10/1998 | Zaniboni | 53/445 |

FOREIGN PATENT DOCUMENTS 35 36 509 A1 4/1987 Germany .

*Primary Examiner*—Daniel B. Moon
*Attorney, Agent, or Firm*—Frommer Lawrence & LLP

[57] ABSTRACT

A device for bending and transferring leaflets into box-shaped casings including a transfer head including elastically openable tapering end portions which cooperate with preforming edges and forming elements rotatably supported in a bending station to bend the side flaps of a leaflet. The transfer head picks up the bent leaflet from the bending station to transfer the bent leaflet into a box-shaped casing. The stop position of the transfer head in the bending station, as well as position of the tapering end portions during bending of the side flaps, can be adjusted depending on the type of paper of which the leaflet is made.

20 Claims, 4 Drawing Sheets

DEVICE FOR BENDING AND TRANSFERRING LEAFLETS INTO BOX-SHAPED CASINGS

FIELD OF THE INVENTION

The present invention relates to a device for bending and transferring leaflets into box-shaped casings, and more particularly, to a device for bending and transferring leaflets which is incorporated in an automatic apparatus for packaging compact discs into respective box-shaped protective casings.

BACKGROUND OF THE INVENTION

It is known that in the compact disc production field and other similar fields, discs are packaged in protective cases, generally made of transparent plastic materials and formed of a box-shaped casing of quadrangular configuration. These protective cases are open on one side thereof so that a so-called tray defining a holding housing for the compact disc which can be inserted and retained therein. In addition, a closing element is hinged on one side border of the box-shaped casing.

In a current packaging process, a leaflet generally carrying information related to the music piece or other data recorded on the compact disc is inserted into the holding casing before that casing is inserted into the tray. This leaflet is formed of a quadrangular flat configuration having two opposite side flaps which are bent at an angle of 90° so as to completely cover the corresponding side walls of the holding casing. These leaflet side flaps have been previously bent by an appropriate bending device associated with the disc packaging apparatus. For instance, in European Patent No. 725 006 in the name of the same applicant as herein, a bending device is disclosed which is generally comprised of a transfer head and a counter-mold between which a leaflet to be bent is interposed. When the transfer head is lowered so as to enter the counter-mold, the leaflet side flaps are automatically bent. The leaflets are then picked up from the counter-mold upon the action of the transfer head, and subsequently introduced into the box-shaped casing arranged at a receiving or laying-down station disposed in side-by-side relationship with the bending station.

It has been found, however, that employment of devices of the above type can result in some operating drawbacks, especially when, as often happens, the type of leaflets utilized changes. In particular, the bending operation is greatly affected by the type of paper forming the leaflet and the thickness thereof. In addition, the bending operation is affected by the presence of possible die-cuttings provided on the leaflet in order to facilitate bending of the same at the desired points. Further, even when die-cut leaflets are employed, it has been found that immediately after bending, due to material elasticity, the leaflet flaps have a tendency to again achieve an orientation coplanar with the base portion of the leaflet. Under these circumstances, spontaneous disengagement of the leaflet from the holding casing can result before insertion of the tray is completed.

The above drawbacks have been partially solved by the prior bending device described in U.S. Pat. No. 4,685,277. In the bending station of the device of U.S. Pat. No. 4,685,277, the leaflet is held tightly between a base block and a transfer head which preferably have the same configuration as the base portion of the leaflet. The leaflet is held tight between the base block and the transfer head with its side borders to be bent projecting externally thereof. Two rollers run along two opposite side walls of the base block with the rollers being elastically urged against the base block to thereby cause bending of the side flaps about tapering end portions defining respective perimetric edges of the transfer head. The tapering end portions of the transfer head have an oblique orientation converging away from the base block, so that bending of the flaps, upon the action of the rollers, takes place at an angle greater that 90°.

More particularly, the design of the end portions of the transfer head is predetermined so that the bent flaps have a tendency to achieve a 90° orientation relative to the base portion of the leaflet as a result of spring back of the material. With the aid of suction cup-like elements associated with the transfer head, the bent leaflet is then removed from the base block to be inserted into the holding casing of the disc case.

Devices of this type, however, have been found to have certain difficulties when they are to be set up, if employment of leaflets of various different types are utilized. The bending action imposed on the flaps may be appropriate for some types of paper, light papers for example, but unsuitable when heavier papers or papers of different types are utilized. In addition, when some types of paper are employed, bending of the side flaps may be maintained at an angle greater than 90° even after spring back of the material. As a result, disengagement of the leaflet from the transfer head and incorrect introduction of the tray into the box-shaped casing of the disc case are more likely.

It has been also found that the rollers do not always perform a sufficiently neat and precise bending, especially when leaflets of rather heavy paper which have not been die-cut are utilized.

OBJECTS OF THE INVENTION

Therefore, it is an object of the present invention to provide a device for bending and transferring leaflets into box-shape casings which avoids the aforementioned disadvantages of the prior art.

An additional object of the present invention is to provide a device for bending and transferring leaflets into box-shaped casings capable of operating in an efficient and reliable manner independent of the type of leaflet utilized.

A further object of the present invention is to provide a device for bending and transferring leaflets into box-shaped casings which is capable of operating in an efficient and reliable manner independent of whether die cuttings are present in the leaflets.

Various other objects, advantages and features of the present invention will become readily apparent from the ensuring detailed description and the novel features will be particularly pointed out in the appended claims.

SUMMARY OF THE INVENTION

In accordance with the present invention, a device for bending and transferring leaflets into box-shaped casings is provided. This leaflet bending and transferring device includes a bending assembly comprised of at least one forming element rotatably engaged in a bending station. The bending assembly has at least one coupling seating extending parallel to a rotational axis of the forming element. The coupling seating is positioned with a tapering end portion for engagement with an end portion thereof so that the leaflet flap is folded around the end portion when the head is brought into a second operating position.

BRIEF DESCRIPTION OF THE DRAWINGS

The following detailed description, given by way of example, will best be understood in conjunction with the accompanying drawings in which.

DETAILED DESCRIPTION OF A PREFERRED EMBODIMENT

Figure 1:
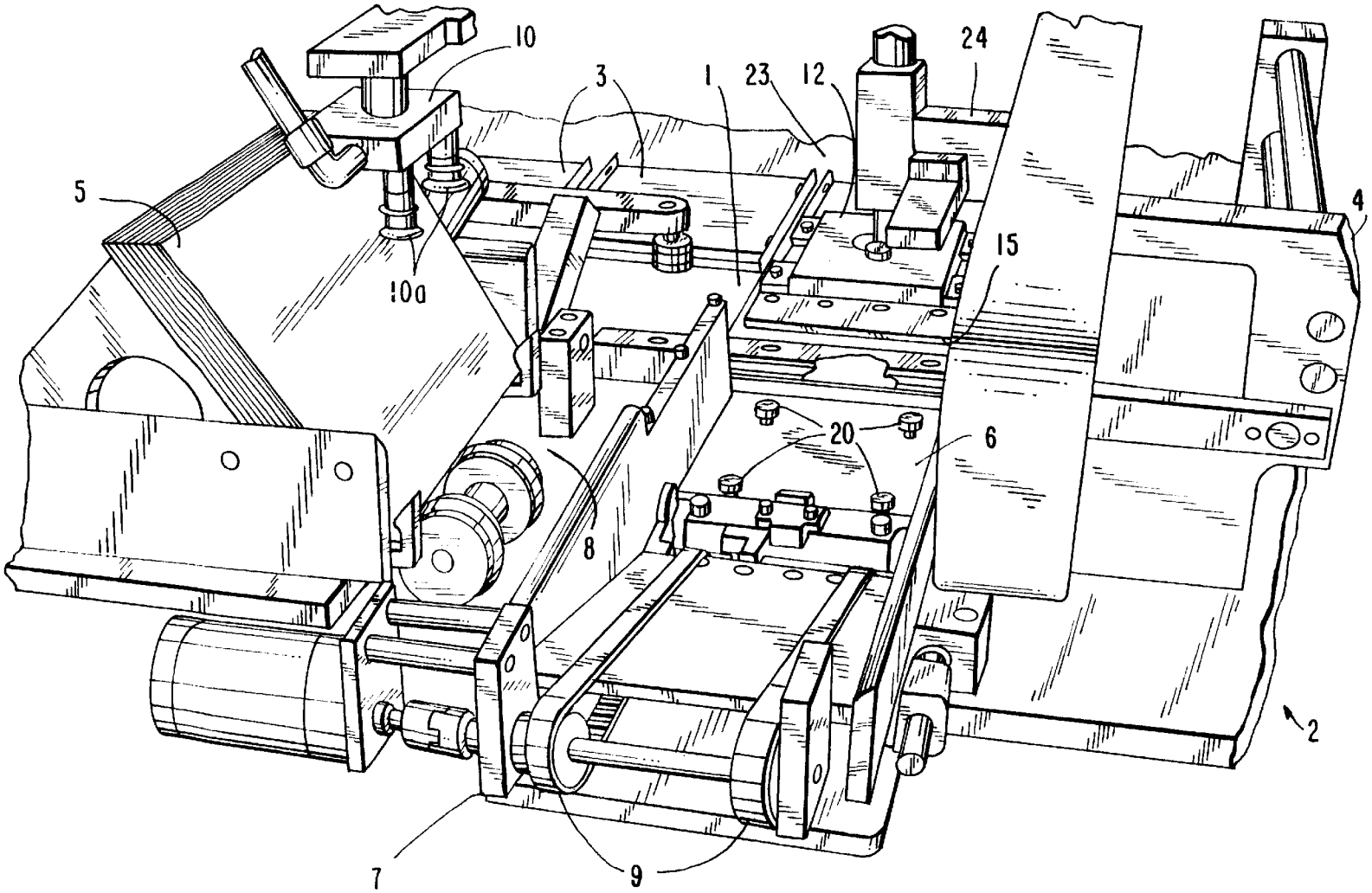
FIG. 1 is a front perspective view of a preferred embodiment of a leaflet bending and transferring device in accordance with the teachings of the present invention which is mounted on an apparatus for packaging compact discs which is only partly shown.

Referring now to the drawings, wherein like reference numerals are used throughout, and particularly to FIG. 1, there is illustrated a device for bending and transferring leaflets into box-shaped casings in accordance with the present invention which has been generally identified by reference numeral 1. As is shown in FIG. 1, this leaflet bending and transferring device 1 is associated with an apparatus 2 for packaging compact discs into disc cases generally denoted by 3 that move forwardly along a packaging line 4 according to a step-by-step movement. This apparatus 2 is described in detail in European Patent No. 725 006 in the name of the same assignee as this application, the disclosure of which is specifically incorporated herein by reference.

The leaflet bending and transferring device 1 of the present invention operates in synchronism with the forward movement of disc cases 3 along a packaging line 4 for insertion of a leaflet 5 into each case 3. Each of the leaflets 5 has a base portion 5*a* and opposite side flaps 5*b* bent at approximately 90° relative to the base portion 5*a*. In order to accomplish this result, the leaflet bending and transferring device 1 comprises a bending station 6 disposed in side-by-side relationship with the packaging line 4 and interlocked to a feed member 7 which positions the individual leaflets 5 into the bending station 6 after receiving them from a feeding magazine 8.

In the embodiment shown in FIG. 1, the feed member 7 generally comprises a belt conveyor 9 terminating at the bending station 6 and a handling device equipped with an oscillating or rocking arm 10 that, with the aid of gripping member in the form of a suction cup 10*a*, picks up the individual leaflets 5 from the feeding magazine 8 for laying them down on the belt conveyor 9.

A possible auxiliary handling device (not shown) can also be utilized for performing transfer of the individual leaflets from the belt conveyor 9 to the bending station 6. Alternatively, leaflet transferring can be accomplished directly by the belt conveyor 9.

The leaflet 5 laid down in the folding station 6 is maintained in engagement on one or more support housings 11. These support housings 11 preferably act on leaflet regions corresponding to the leaflet side flaps 5*b* to support the leaflet in an interposition condition between the movable transfer head 12 and the bending member 13. This bending member 13 is arranged to cooperate with the transfer head 12 to fold over the side flaps 5*b* of the leaflet 5 (see chain line in FIG. 2).

Figure 2:
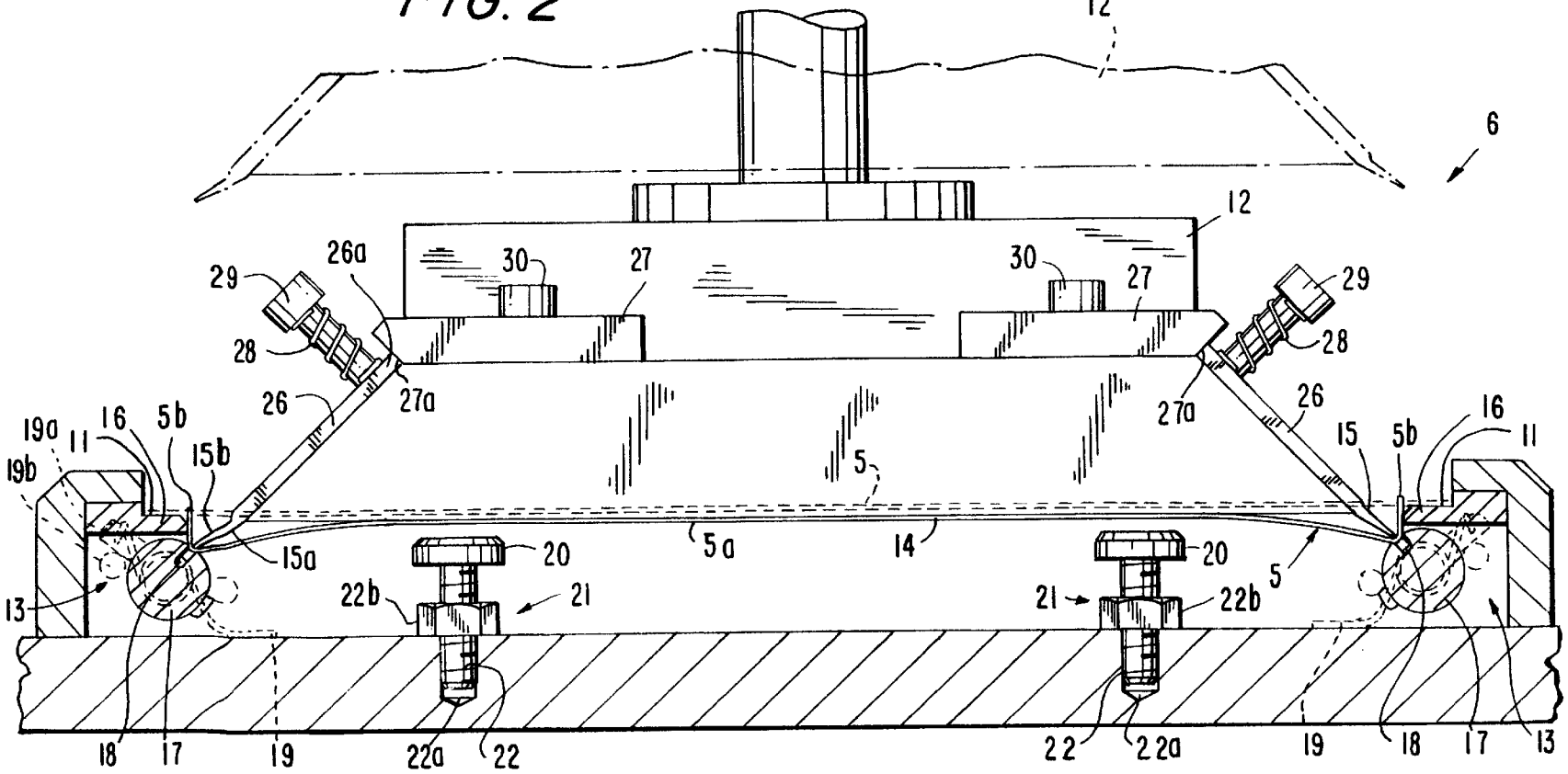
FIG. 2 is a cross-sectional view of a bending station incorporated in the leaflet bending and transferring device of FIG. 1 specifically illustrating a preforming step of the leaflet.
Figure 3:
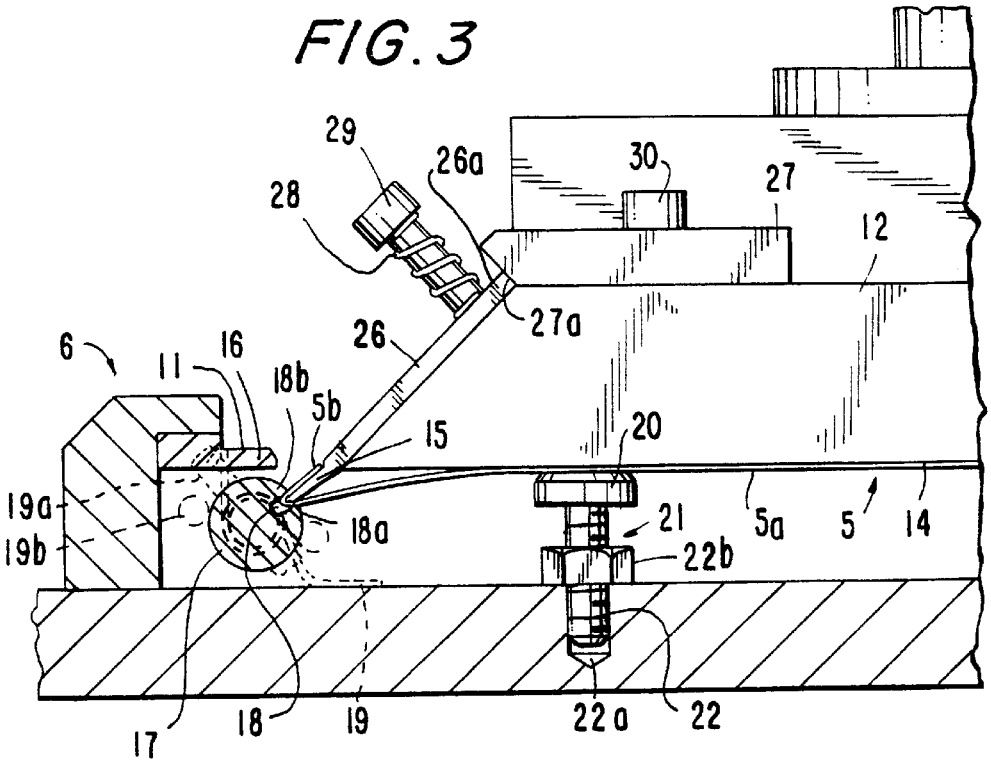
FIG. 3 is a fragmentary view of the bending station shown in FIG. 2 during an operating step in which bending of the leaflet is completed.

The transfer head 12 moves in a reciprocating motion, preferably in a vertical direction, between a first operating position, as shown in chain line in FIG. 2, wherein the transfer head 12 is spaced apart from the bending station 6 in alignment therewith, and a second operating position, as shown in solid lines in FIGS. 2 and 3, wherein the transfer head 12 operates on leaflet 5 so as to fold over the side flaps 5*b* thereof in cooperation with the bending member 13.

As is illustrated in the accompanying drawings, the transfer head 12 includes a base surface 14 facing the bending station 6 which is arranged to act on the base portion 5*a* of leaflet 5, and at least one tapering end portion 15 disposed peripherally relative to the base surface 14 along a side of the latter. More specifically, the transfer head 12 of the leaflet bending and transferring device 1 of the present invention includes two tapering end portions 15 which are disposed laterally on opposite sides relative to the base surface 14. The tapering end portions 15 have an orientation diverging obliquely from the movement direction of the transfer head 12 and project from the base surface 14 in the movement direction of the head towards the second operating position. In addition, as is best shown in FIG. 2, the tapering end portions 15 are mutually spaced apart by a distance less than the linear extension of the leaflet 5. Therefore, when the leaflet 5 is positioned on the support housings 11 arranged in the bending station 6, the leaflet side flaps 5*b* project laterally relative to the tapering end portions 15 of the transfer head 12.

Figure 4:
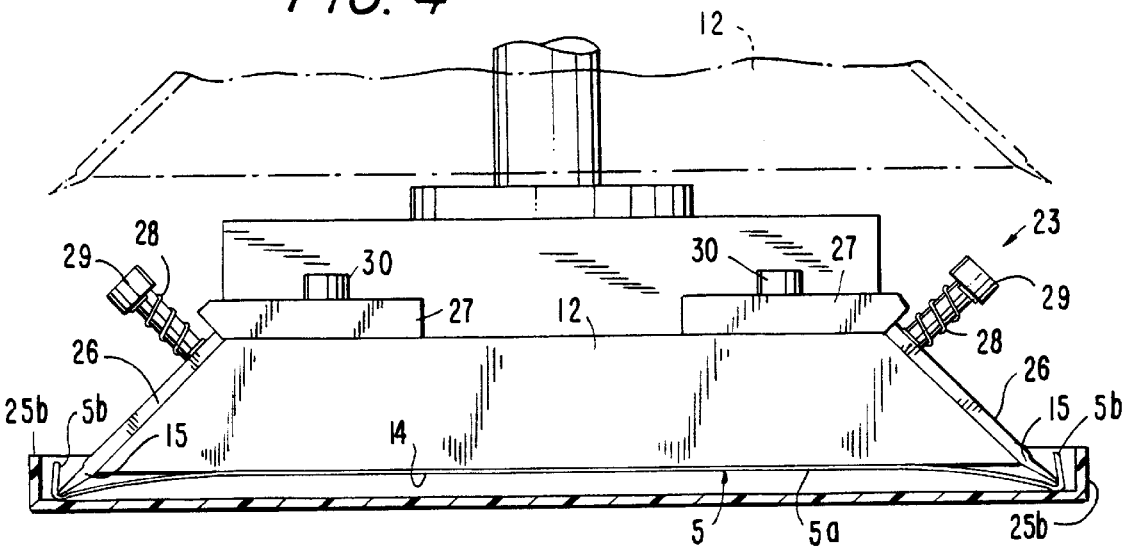
FIG. 4 is an elevational view illustrating a transfer head of the leaflet bending and transferring device of FIG. 1 during an operating step wherein a bent leaflet is about to be inserted into a box-shaped casing.

During movement from its first to its second operating position, the transfer head 12 brings the extremities of the tapering end portions 15 into contact with the leaflet 5. This contact occurs along the bending lines of the side flaps 5*b* of leaflet 5 wherein the side flaps 5*b* will be folded. During this step, suction-cup elements or similar suction members (not shown) converging on the base surface 14 of the transfer head 12 force the base portion 5*a* of leaflet 5 against the base surface 14. Projection of the tapering end portions 15 relative to the base surface 14 forces leaflet 5, under this circumstance, to achieve an arch-shaped configuration, as illustrated in FIGS. 2, 3 and 4. As the transfer head 12 is further lowered towards its second operating position, the tapering end portions 15 interact with the bending means 13 to bend the side flaps 5*b*.

According to a preferred feature of the leaflet bending and transferring device of the present invention, the bending assembly comprises at least one preforming edge 16, and more specifically, a pair of preforming edges 16, each of which is arranged to cooperate with the corresponding tapering end portion 15 to bend the leaflet side flaps 5*b* substantially at an angle of 90°. To this end, the relative positioning between each preforming edge 16 and the corresponding tapering end portion 15 is arranged such that a gauged passage is defined between them which is of a width substantially equal to or slightly greater than the thickness of the leaflet 5.

Preferably, as best shown in FIGS. 2 and 3, the upper part of each preforming edge 16 defines one of the support housings 11. Therefore, cooperation between the tapering end portions 15 and the preforming edges 16 occurs as soon as the tapering portions descend downwardly to a level lower than the lying plane of leaflet 5 on the support housings 11.

Additionally, forming elements 17 are arranged adjacent to the preforming edges 16 which are each intended for cooperation with one of the tapering end portions 15 when the transfer head 12 reaches its second operating position. Therefore, each forming element 17 includes at least one coupling seating 18 extending in vertical alignment with the tapering end portion 15 so that the tapering end portion engages the coupling seating 18 when the transfer head 12 is about to reach its second operating position.

In particular, each forming element 17 is generally defined by a cylindrical body rotatably engaged in the bending station 6 according to its geometric rotation axis, disposed at a position laterally spaced away from the transfer head 12 relative to the extremity of the tapering end portion 15. The coupling seating 18 is advantageously defined by a groove of rectangular profile extending along a generatrix of the cylindrical body 17.

More specifically, as viewed from FIGS. 2 and 3, the coupling seating 18 has a first locating edge 18*a* adapted to act in interference relationship on an inner side 15*a* of the tapering end portion 15 when, following descent of the transfer head 12 to its second operating position, the end portion 15 enters groove 18. Interference between the first locating edge 18*a* and the inner side 15*a* of the tapering end portion 15 causes the forming element 17, following a subsequent slight lowering of head 12 towards its second operating position, to be forced to rotate about its own axis.

Due to the angular rotation of the forming element 17, a second locating edge 18*b* of the groove forming the coupling seating 18 is brought into abutment relationship against an outer side 15*b* of the tapering end portion 15, on the laterally opposite side relative to the first locating edge 18*a*. As a result, a net bending of the side flap 5*b* about the extremity of the tapering end portion 15 occurs. The angular rotation of each forming element 17 occurs against the action of at least one torsion spring 19 or equivalent return spring such that, in cooperation with stop pegs 19*a*, 19*b* located on the forming element 17 and a fixed portion of the bending station 6 respectively, positioning of the coupling seating 18 in alignment with the extremity of the tapering end portion 15 results when the transfer head 12 is again moved away from its second operating position.

Upon reaching its second operating position, movement of the transfer head 2 is stopped by one or more stop elements 20 engaged in the bending station 6 and acting in abutment relationship against the base surface 14 of the transfer head 12. In particular, first adjustment members 21 are associated with the stop elements 20 which precisely adjust the limit stroke of the transfer head 12 in its second operating position. In accordance with this adjustment member 21, each stop member 20 can be fastened to an end of a screw-threaded rod 22 operatively engaged in a screw-threaded hole 22*a* arranged in the bending station. A locking nut 22*b* enables a precise and steady fastening of the respective stop element 20 to the desired position. Since the transfer head 12 intervenes with respect to the stop elements 20 when it is stopped in its second operating position, the amount of the angular rotation imparted to the forming elements 17 can be advantageously adapted to the type and thickness of the paper forming leaflet 5.

Therefore, the stop position of the transfer head 12 in its second operating position can be advantageously adjusted in such a manner that, independently of the type and thickness of the paper forming leaflet 5, the side flaps 5*b* are folded over at an angle greater than 90°. Accordingly, the flaps, as a result of the material elasticity, spontaneously achieve an orientation of substantially 90° relative to the base portion 5*a* when, following return of the transfer head 12 to its first operating position, the tapering end portions 15 are disengaged from the bending member 13.

The leaflet bending and transferring device 1 of the present invention also includes a transfer assembly that transfers the bent leaflet 5 from the bending station 6 to a laying-down station 23 disposed along the packaging line 4. Preferably, this transferring assembly includes the same transfer head 12, the latter being mounted on a handling arm 24 (see FIG. 1) performing translational movement thereof in a horizontal direction or in any case perpendicularly to the movement direction of the first and second operating positions.

In more detail, upon activation of the handling arm 24 (only partly shown in FIG. 1), the transfer head 12 is moved from its first operating position to a third operating position, as shown in chain line in FIG. 4, wherein the transfer head 12 is disposed in alignment with and spaced apart from a box-shaped casing 25 forming a portion of a disc case 3. Once the transfer head 12 has reached its third operating position, the transfer head 12 moves in a vertical stroke to a fourth operating position wherein the leaflet 5 engaged therewith is inserted into the box-shaped casing 25.

In accordance with a further feature of the leaflet bending and transferring device 1 of the present invention, each of the tapering end portions 15 is formed on a plate-like element 26 oscillatably engaged with a corresponding side of the transfer head 12. More particularly, the plate-like element 26 has, on an opposite side from the tapering end portion 15, an end edge 26*a* operatively engaged in a constraint housing defined between the corresponding side wall of the transfer head 12 and a locating block 27 fastened to the transfer head. One or more springs or equivalent counter spring members 28 act between locating elements 29 fixedly supported by the transfer head 12 and the plate-like element 26 to retain the latter laterally urged against the transfer head. In this manner, the locating elements 26, and consequently, the end portions 15 are laterally movable relative to the base surface 14 of the transfer head 12 against the biasing force of counter springs 28.

Figure 5:
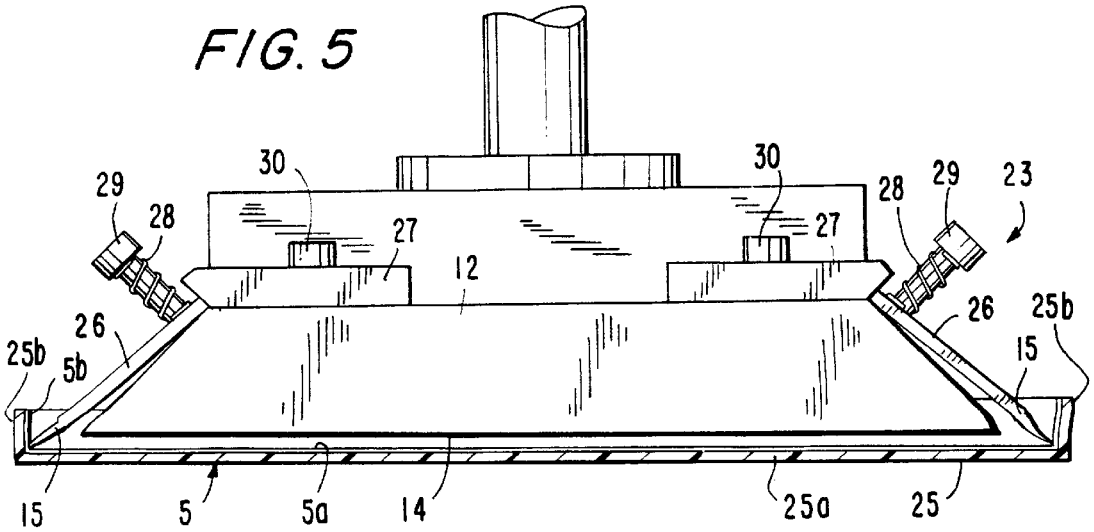
FIG. 5 is a view similar to the view of FIG. 4 specifically illustrating the transfer head thereof during an operating step wherein insertion of the leaflet into the box-shaped casing is completed.

In comparing FIGS. 4 and 5, when the transfer head 12 moves close to the fourth operating position, the tapering end portions 15 are brought into abutment relationship against a bottom wall 25*a* of the box-shaped casing 25, but yet are slightly spaced apart form the side walls 25*b* of the casing. By a slight further forward movement of the transfer head 12 to its fourth operating position, the end portions 15 are forced to slightly open wider from the transfer head 12 by pivoting or rotating about the constraint points of the end edges 26*a* of the plate-like elements 26 and consequently slide along the bottom wall 25*a* of casing 25. In this manner, the side flaps 5*b* of leaflet 5 are forced against the side walls 25*b* of casing 25. Meanwhile, the suction effect of the suction member associated with the transfer head 12 is stopped so that the base portion 5*a* of leaflet 5 (an arch-shaped configuration), is extended in coplanar relationship with the bottom wall.

During the starting step for moving the transfer head 12 upwardly towards its third operating position, the tapering end portions 15 will be retracted to their initial position by counter springs 28. Thus, assurance of a complete disengagement of the leaflet 5 from the transfer head 12 is achieved, and the risk that the tapering end portions 15 would interfere with the side flaps 5*b*, should the latter remain bent at an angle slightly greater than 90°, is also eliminated.

Figure 6:
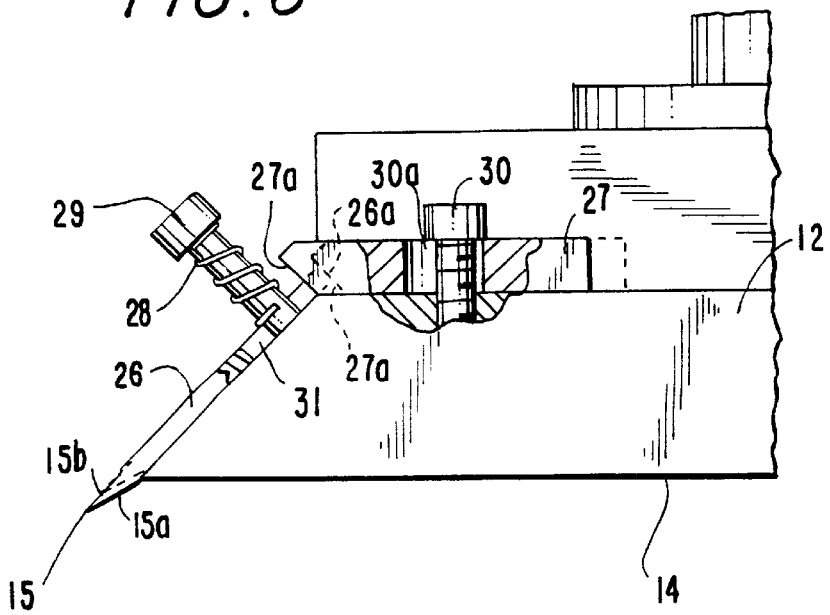
FIG. 6 is an enlarged fragmentary side view in detail of the transfer head employed in the leaflet bending and transferring device of the present invention specifically illustrating adjustment of the transfer head for adaptation of the device to different types of paper.

Advantageously, positioning of the tapering end portions 15 relative to the transfer head 12 can be adjusted, depending on the type and thickness of the paper forming leaflet 5, for example, as well as upon the sizes of the box-shaped casing. To this end, as best shown in FIG. 6, each of the locating blocks 27 can be positioned longitudinally relative to the transfer head 12 with the blocks 27 being removable fastened to the transfer head 12 by screw-threaded locking elements 30 operating through respective elongated holes 30*a* arranged in the locating elements.

Rest housings 27*a* for the end edges 26*a* of the plate-like elements 26 are defined by inclined surfaces, so that following a longitudinal displacement of the locating block 27, the plate-like element 26 is displaced in its lying plane. As a result, the tapering end portion 15 projects to a certain preferable extent relative to the base surface of the transfer head 12, to in turn adjust the width of the gauged passage defined with the respective preforming edge 16. Auxiliary elongated slide holes 31 arranged in each plate-like element 26 enable guided sliding of the plate-like element 26 relative to the locating elements 29 carrying counter springs 28.

Accordingly, in accordance with a general object of the present invention, the leaflet bending and transferring of the present invention can be operationally adaptable to any type and weight of the leaflet paper.

Moreover, the structure and operation of the forming elements 17 is so conceived that formation of precise folds are ensured even in the absence of die cuttings on the leaflets being bent and transferred. In addition, mobility of the tapering end portions 15 ensures release of the leaflet 5 into the casing 25. Further, positioning of the bent flaps 5*b* against the side walls 25*b* compensates for wide size tolerances in the casing.

While the present invention has been particularly shown and described with reference to certain preferred embodiments, it will be readily apparent to those of ordinary skill in the art that various changes and modifications may be made therein without departing from the spirit and scope of the invention. It is intended that the appended claims be interpreted as including the foregoing as well as various other such changes and modifications.

What is claimed is:

1. A device for bending and transferring leaflets into box-shaped casings comprising:

a bending station, a feed means for transferring at least one leaflet to the bending station, a transfer head movable in a reciprocating motion between a first operating position, wherein said transfer head is spaced apart from the bending station and in alignment therewith, and a second operating position, wherein said transfer head impinges upon the leaflet supported in the bending station, said transfer head having a base surface facing the bending station and at least one tapering end portion disposed perimetrically relative to the base surface, and wherein said transfer head is not part of said feed means and does not contact the leaflet until the leaflet is fed into the bending station, bending means operating in said bending station for bending, in cooperation with the transfer head, at least one side flap of the leaflet which projects from said end portion of said transfer head, said bending means comprising at least one forming element rotatably engaged in said bending station and having at least one coupling seating extending generally parallel to a rotational axis of the forming element, in alignment with said tapering end portion, for engagement with said end portion by bending the leaflet flap around said end portion when the transfer head is moved to its said second operating position, and transfer means for transferring the bent leaflet from the bending station to a box-shaped casing located in a receiving station.

2. The bending and transferring device as claimed in claim 1, wherein said forming element comprises a cylindrical body engaged in the bending station in a rotatable manner, said cylindrical body including at least one groove extending along a generatrix thereof to define said at least one coupling seating.

3. The leaflet bending and transferring device as claimed in claim 2, wherein said coupling seating has a first locating edge abutting an inner side of said tapering end portion to angularly rotate said forming element when the transfer head is moved to its second operating position, and a second locating edge abutting against an outer side of the tapering end portion on the laterally opposite side relative to said first locating edge after said forming element is rotated.

4. The leaflet bending and transferring device as claimed in claim 1, and further comprising return spring means for providing a bias force against rotation of the forming element.

5. The leaflet bending and transferring device as claimed in claim 1, wherein said bending means further comprises at least one preforming edge extending adjacent to said forming element and arranged to cooperate with said tapering end portion to bend said leaflet flap before said tapering end portion is brought into engagement with said forming element.

6. The leaflet bending and transferring device as claimed in claim 5, wherein said at least one preforming edge defines a support housing for supporting the leaflet between said transfer head disposed in its first operating position and said bending means.

7. The leaflet bending and transferring device as claimed in claim 1, and further comprising at least one stop element operating on said transfer head to stop forward movement of said transfer head at a stop location thereof defined at its second operating position and adjustment means associated with said stop element for adjusting the stop location of said transfer head in its said second operating position.

8. The leaflet bending and transferring device as claimed in claim 1, wherein said tapering end portion projects from the base surface in a direction of movement of said transfer head towards its second operating position.

9. The leaflet bending and transferring device as claimed in claim 8, wherein said tapering end portion diverges obliquely from the movement direction of the transfer head between its said first and second operating positions.

10. The leaflet bending and transferring device as claimed in claim 8, wherein said tapering end portion is formed on a plate-like element removably engaged with said transfer head.

11. The leaflet bending and transferring device as claimed in claim 10, wherein said end portion can be laterally moved away from said base surface against the action of counter spring means.

12. The leaflet bending and transferring device as claimed in claim 11, wherein said counter spring means operates between locating elements rigidly supported by said transfer head and said plate-like element, said plate-like element being linked in an oscillatable manner to a side wall of said transfer head.

13. The leaflet bending and transferring device as claimed in claim 10, and further comprising adjustment means for setting the position of said plate-like element on said transfer head.

14. The leaflet bending and transferring device as claimed in claim 13, wherein said adjustment means comprises at least one locating block having an inclined abutment plane on which an end edge of the plate-like element opposite to said tapering end portion abuts against said locating block being adapted to be selectively positioned on said transfer head in order to adjust positioning of said tapering end portion.

15. The leaflet bending and transferring device as claimed in claim 1, wherein said transferring means is generally formed of said transfer head with said transfer head being movable generally perpendicular to the direction between its said first and second operating positions to transfer said leaflet from said bending station to a receiving station.

16. The leaflet bending and transferring device as claimed in claim 15, wherein in said receiving station, said transfer head is movable from a third operating position to a fourth operating position wherein the bent leaflets are inserted into the box-shaped casings.

17. A device for bending and transferring leaflets into box-shaped casings comprising:

a bending station;

feed means for transferring at least one leaflet to the bending station;

a transfer head movable between a first operating position, wherein said transfer head is spaced apart from the bending station, and a second operating position, wherein said transfer head impinges upon the leaflet supported in the bending station, said transfer head having at least one tapering end portion, and wherein said transfer head is not part of said feed means and does not contact the leaflet until the leaflet is fed into the bending station;

bending means operating in said bending station for bending, in cooperation with said transfer head in its said second operating position, at least one side flap of the leaflet, said bending means comprising at least one forming element which bends the leaflet flap around said end portion when the transfer head is moved to its said second operating position, and wherein said at least one forming element of said bending means has at least one coupling seating extending generally parallel to a rotational axis of the forming element, in alignment with said tapering end portion, for engagement with said end portion, by bending the leaflet flap around said end portion when the transfer head is moved to its second operating position; and transfer means for transferring the bent leaflet from the bending station to a box-shaped casing located in a receiving station.

18. The leaflet bending and transferring device as claimed in claim 17 wherein said transfer head has a base surface facing the bending station with said at least one tapering end portion being disposed perimetrically relative to the base surface.

19. The leaflet bending and transferring device as claimed in claim 17 wherein said at least one forming element of said bending means has at least one coupling seating extending generally parallel to a rotational axis of the forming element, in alignment with said tapering end portion, for engagement with said end portion, by bending the leaflet flap around said end portion when the transfer head is moved to its second operating position.

20. The leaflet bending and transferring device of claim 17, and further comprising at least one stop element operating on said transfer head to stop forward movement of said transfer head at a stop location thereof defining its second operating position and adjustment means associated with said stop element for adjusting the stop location of said transfer head in its said second operating position.

* * * * *

UNITED STATES PATENT AND TRADEMARK OFFICE

CERTIFICATE OF CORRECTION

PATENT NO. : 6,035,605

DATED : March 14, 2000

INVENTOR(s) : Luciano Perego

It is certified that errors appear in the above-identified patent and that said Letters Patent is hereby corrected as shown below:

On the cover page of the patent at line item [54] (Title of the Invention) change "DEVICE FOR BENDING AND TRANSFERRING LEAFLETS INTO BOX-SHAPED CASINGS" to --A DEVICE FOR BENDING AND TRANSFERRING LEAFLETS INTO BOX-SHAPED CASINGS;

On the cover page of the patent at line item [30] (Foreign Application Priority Data) change "97830357" to --97830357.6--; and On the cover page of the patent (Attorney, Agent or Firm) change "Frommer Lawrence & LLP" to --Frommer Lawrence & Haug LLP--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*